US007533759B2

(12) United States Patent
Krueger et al.

(10) Patent No.: US 7,533,759 B2
(45) Date of Patent: May 19, 2009

(54) ACTIVE MUFFLER FOR AN EXHAUST SYSTEM

(75) Inventors: Jan Krueger, Neuhausen (DE); Frank Castor, Esslingen (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 0 days.

(21) Appl. No.: 11/848,798

(22) Filed: Aug. 31, 2007

(65) Prior Publication Data

US 2008/0053747 A1 Mar. 6, 2008

(30) Foreign Application Priority Data

Sep. 6, 2006 (DE) ..... 10 2006 042 224

(51) Int. Cl.
*F01N 1/06* (2006.01)
*G10K 11/16* (2006.01)
*F01N 1/02* (2006.01)

(52) U.S. Cl. ..... 181/206; 181/250; 381/71.5; 381/71.2; 381/71.7

(58) Field of Classification Search ..... 181/206, 181/250, 266, 273, 276; 381/71.5, 71.9, 381/71.8, 71.2, 71.7; 123/184.57
See application file for complete search history.

(56) References Cited

U.S. PATENT DOCUMENTS

| | | | | |
|---|---|---|---|---|
| 4,527,282 | A * | 7/1985 | Chaplin et al. | 381/71.5 |
| 5,097,923 | A * | 3/1992 | Ziegler et al. | 181/206 |
| 5,229,556 | A * | 7/1993 | Geddes | 181/206 |
| 5,233,137 | A * | 8/1993 | Geddes | 181/206 |
| 5,446,249 | A * | 8/1995 | Goodman et al. | 181/206 |
| 5,457,749 | A * | 10/1995 | Cain et al. | 381/71.5 |
| 5,466,899 | A * | 11/1995 | Geisenberger | 181/206 |
| 5,541,373 | A * | 7/1996 | Cheng | 181/206 |
| 5,550,334 | A * | 8/1996 | Langley | 181/206 |
| 5,574,264 | A * | 11/1996 | Takemori et al. | 181/206 |
| 5,619,020 | A * | 4/1997 | Jones et al. | 181/206 |
| 5,693,918 | A * | 12/1997 | Bremigan et al. | 181/206 |
| 5,748,749 | A * | 5/1998 | Miller et al. | 381/71.5 |
| 6,005,957 | A * | 12/1999 | Meeks | 381/386 |
| 6,160,892 | A * | 12/2000 | Ver | 381/71.5 |
| 6,385,321 | B1 * | 5/2002 | Krueger et al. | 381/71.7 |
| 6,758,304 | B1 * | 7/2004 | McLean | 181/206 |
| 6,963,647 | B1 * | 11/2005 | Krueger et al. | 381/71.5 |
| 7,006,639 | B2 * | 2/2006 | Hobelsberger | 381/96 |
| 7,293,627 | B2 * | 11/2007 | Kruger et al. | 181/206 |
| 2002/0071571 | A1 * | 6/2002 | Vanderveen et al. | 381/71.4 |
| 2003/0178248 | A1 * | 9/2003 | Mammarella et al. | 181/206 |

FOREIGN PATENT DOCUMENTS

| | | | |
|---|---|---|---|
| EP | 0 674 097 | A1 | 9/1995 |
| EP | 0 939 577 | A2 | 9/1999 |
| EP | 1 055 804 | | 11/2000 |
| JP | 58214613 | A * | 12/1983 |
| JP | 09 209860 | | 8/1997 |

* cited by examiner

*Primary Examiner*—Edgardo San Martin
(74) *Attorney, Agent, or Firm*—McGlew and Tuttle, P.C.

(57) ABSTRACT

The present invention relates to an active muffler for an exhaust gas system of an internal combustion engine, in particular in a motor vehicle, having at least one antinoise generator for applying antinoise to the exhaust gas, whereby the antinoise generator has a diaphragm drive with which it is coupled via at least one coupling element in a thermally conducting and noise-reducing manner to an outside wall of the muffler, which is in contact with the environment.

20 Claims, 1 Drawing Sheet

ACTIVE MUFFLER FOR AN EXHAUST SYSTEM

The present invention relates to an active muffler for an exhaust system of an internal combustion engine, in particular in a motor vehicle.

Because of steadily increasing demands with regard to the allowed noise emission by exhaust systems, in recent years exhaust systems using so-called active noise control by antinoise have been used to an increasing extent. Functioning is based on triggering of two superimposed sound signals, with a synthetically generated signal in phase opposition (antinoise), usually emitted by loudspeakers, being superimposed on the interfering sound of the exhaust system in such a way that the interfering signal is preferably completely obliterated. One advantage of such active systems consists in particular in their small size and flexibility, so that modern systems in particular can adapt dynamically to changes in operating conditions such as different rotational speeds or different engine noises. However, the temperature stress which usually prevails in an exhaust system and must be endured by the antinoise generator for a long period of time without suffering any impairment is a critical factor. In a modern exhaust system with active mufflers, an attempt is made to isolate the active muffler from the exhaust system and/or additionally cool it.

EP 1 055 804 B1 discloses an active exhaust muffler for an exhaust system in a motor vehicle, comprising a housing through which passes an exhaust pipe having a sound coupling point in its pipe wall. In addition, an input point for antinoise is also provided, this location being connected to the sound coupling point via the interior of the housing, which forms a resonance channel. In general, the section containing the input point and the section of the resonance channel containing the sound coupling point are separated from one another by a cooling gap through which cool air passes, so that a compact design is to be implemented on the one hand, while on the other hand sufficient cooling of a heat-sensitive loudspeaker can be implemented. However, the design of the cooling channel and/or the cooling gap is complicated and is therefore expensive.

The present invention relates to the problem of providing an improved embodiment for an active exhaust muffler in which improved cooling of an antinoise generator in particular is achieved through a simple design measure.

This problem is solved according to this invention by the subject of the independent claims. Advantageous embodiments are also the subject of the dependent claims.

The present invention relates to the general idea of connecting an especially heat-sensitive part of an antinoise generator to an outside wall around which cooler ambient air flows and to do so in a manner that transmits heat while at the same time reducing noise in an active muffler for an exhaust system of an internal combustion engine and to thereby effectively cool this part on the one hand, while on the other hand preventing sound from being transferred from the diaphragm drive of the antinoise generator to the environment via the outside wall. The antinoise generator is designed to generate antinoise for acting on exhaust gases, and to this end it has a diaphragm drive, in particular an electromechanical diaphragm drive in the manner of a vibration generator, which generates the required antinoise signals and relays them to a diaphragm. The diaphragm drive of the antinoise generator in particular generates heat during operation of the antinoise generator in addition to the heat of the exhaust gases, so it is advantageous to actively cool the antinoise generator by connecting it to the abovementioned outside wall by a coupling element that conducts heat and suppresses sound. The heat-transferring coupling between the outside wall and the diaphragm drive of the antinoise generator results in a flow of heat from the diaphragm drive over the coupling element and the outside wall into the environment and therefore leads to active cooling of the diaphragm drive. At the same time, the noise reduction coupling, e.g., a mechanically elastic coupling, prevents transfer of the vibration of the diaphragm drive to the outside wall, which is in contact with the environment, thereby counteracting the noise reduction effect of the active muffler.

The coupling element is expediently made of a heat-conducting material which suppresses sound at the same time. Tough substances that conduct heat well, e.g., in the form of so-called heat-conducting pastes or a layer of an elastic material that conducts heat well, e.g., a so-called heat-conducting pad, are conceivable here. In addition to their excellent thermal conduction, these substances and/or materials due to their high compressibility fulfill the function of equalizing the tolerance, which is required in manufacturing, of a gap between the outside wall and the diaphragm drive of the antinoise generator, where said diaphragm drive or antinoise generator must be present from a technical acoustic standpoint but on the other hand should be designed to be as small as possible. Such a heat-conducting paste thus allows a good heat transfer between the diaphragm drive of the antinoise generator and the outside wall which is in contact with the environment so that heat can be dissipated rapidly through the outside wall and therefore effective cooling of the diaphragm drive can be achieved. At the same time, the elasticity of the heat-conducting paste produces an acoustic separation between the diaphragm drive and the outside wall.

In an advantageous refinement of the invention approach, the antinoise generator is a loudspeaker which has a vibrating diaphragm that can be excited by the diaphragm drive. Conventional commercial loudspeakers which cover a required bandwidth of frequencies for generating suitable antinoise may be used here. However, it is important for the loudspeaker to be able to tolerate a certain thermal stress over a long period of time without being damaged, whereby the loudspeaker must be able to tolerate temperatures occurring in the exhaust system preferably over the entire lifetime of the active muffler.

In another advantageous embodiment of the inventive approach, the outside wall which is in contact with the environment has at least one of the following heat transfer elements: flanging, structured surface, wind deflector plate. All three heat transfer elements contribute toward increasing the surface area of the outside wall and thereby accelerating the heat exchange with the environment. Flanging in particular or cooling ribs are adequately well known for increasing the heat transfer. Likewise, so-called wind deflector plates which deflect and/or guide the relative wind or slipstream in driving, so that the highest possible rate of heat transfer can be achieved. When arranged properly, they increase the heat transfer between the environment and the outside wall and therefore also heat transfer between the diaphragm drive and the outside wall, so the diaphragm drive can be cooled more effectively and therefore its lifetime can be prolonged.

Other important features and advantages of the invention are derived from the subclaims, the drawings and the description of the figures on the basis of the drawings.

It is self-evident that the features mentioned above and those yet to be described below may be used not only in the particular combination given here but also in other combinations or alone without going beyond the scope of the present invention.

Preferred exemplary embodiments of the invention are depicted in the drawings and explained in greater detail in the following description, where the same reference numerals refer to the same or similar or functionally identical components.

Figure 1:
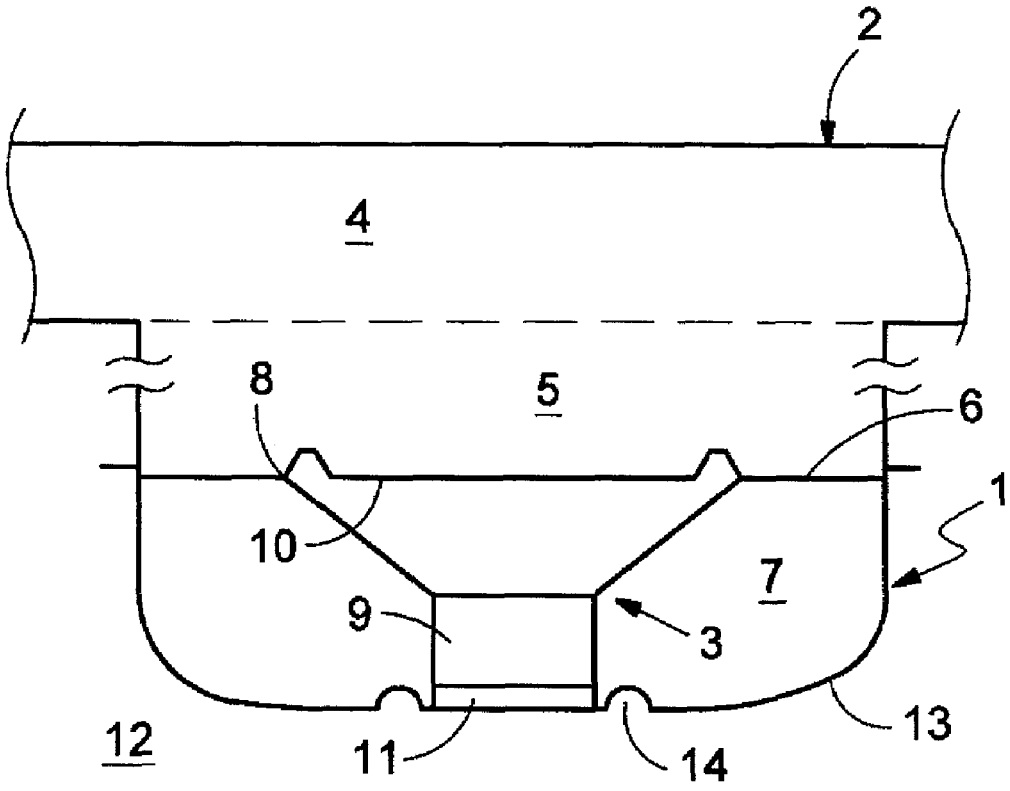
FIG. 1 shows a sectional diagram through an inventive active muffler.

According to FIG. 1, an inventive active muffler 1 for an exhaust system 2, shown only partially here, of an internal combustion engine comprises at least one antinoise generator 3 for having antinoise act on the exhaust gas. The exhaust gas system 2 may be designed in particular as illustrated in FIG. 1 where it has a pipe 4 which carries exhaust gas and is permeable to sound, in particular through perforations, in the area of the muffler 1. A different arrangement and/or embodiment of the pipe 4 carrying exhaust gas is of course also conceivable. In this case, an interior of the pipe 4 carrying exhaust gas is connected so it communicates, acoustically at least, with a first space 5 of the active muffler 1. The first space 5 is in turn separated from a second space 7 by a partition 6, whereby the partition 6 has a wall opening 8. It should be pointed out here explicitly that the diagram selected for FIG. 1, showing the pipe 4 which carries exhaust gas, the first space 5, the partition 6 and the second space 7, is to be understood merely as an example, so that other embodiments and/or arrangements of the antinoise generator 3 are also to be understood as included within the scope of the invention with regard to the exhaust system 2.

In the second space 7, the antinoise generator 3 is situated, whereby it consists of at least one vibration-generating diaphragm drive 9 and a diaphragm 10 emitting these vibrations. The antinoise generator 3 is arranged in the second space 7 in such a way that it can act upon the first space 5 with antinoise through the wall opening 8. It is conceivable here that the diaphragm 10 of the antinoise generator 3 may tightly seal the wall opening 8. It is also conceivable for the diaphragm 10 of the antinoise generator 3 to be part of the partition 6 and to be manufactured together with it, for example.

During operation of the active muffler 1, the antinoise generator 3 generates sound signals which preferably eliminate the sound waves emitted by the exhaust gas flowing in the pipe 4. This may be accomplished, for example, by a phase-shifted emission of antinoise signals which cover the interfering signals generated by the exhaust gas flowing through the exhaust pipe 4 so that the latter are eliminated.

Since the exhaust gas system 2 can reach relatively high operating temperatures during operation, and furthermore, the diaphragm drive 9 also generates heat during operation, there may be high thermal stresses which have a negative effect on the lifetime of the antinoise generator 3. To counteract this and thus be able to prolong the lifetime of the antinoise generator 3, the latter should preferably be cooled. In the inventive approach, such cooling is achieved by the fact that the diaphragm drive 9 of the antinoise generator 3 is coupled via at least one coupling element 11 to an outside wall 13 of the muffler 1, which is in contact with the environment 12, in such a way as to conduct heat and reduce noise. The heat-conducting and noise reduction coupling element 11 then achieves a heat transfer from the diaphragm drive via the coupling element 11 into the outside wall 13 of the muffler 1 from which the heat can be dissipated into the environment 12. The outside wall 13 thus acts as a cooling surface for the diaphragm drive 9.

The sound-suppressing design of the coupling element 11, however, prevents any transfer of sound from the antinoise generator 3 to the outside wall 13 and emission therefrom into the environment 12. The coupling element 11 may be made of a heat-conducting and at the same time noise reduction material, e.g., in the form of a tough substance such as a heat-conducting paste or a layer of an elastic material having a good thermal conductivity. In addition to an increased thermal conduction, such a substance and/or such a material fulfills a tolerance equalizing function, which is necessary for the manufacture of the muffler 1 because there must always be a gap between the diaphragm drive 9 and the outside wall 13, although it should be as small as possible. The diaphragm drive 9 may be a conventional magnetic coil, for example. Another important property of the coupling element 11 is a certain mechanical elasticity which prevents a transfer of sound waves from the diaphragm drive 9 via the coupling element 11 into the outside wall 13. This prevents the outside wall 13 from functioning as a sound-emitting diaphragm, thereby destroying the noise reduction effect of the antinoise generator 3. The coupling element 11 usually has a thickness of approx. 0.1 mm to approx. 5 mm.

To be able to further increase the heat transfer between the outside wall 13 and the diaphragm drive 9 of the antinoise generator 3 via the coupling element 11 and thus be able to achieve a further improvement in the cooling of the diaphragm drive 9, the outside wall 13 of the muffler 1 which is in contact with the environment 12 is designed so that there can be an increased heat transfer with the environment 12. This is achieved, for example, through special heat transfer elements 14 or through a suitable design of the surface of the outside wall 13. A suitably shaped surface may have a highly fissured structure so that the surface area is increased and thus the cooling effect is supported. Examples of possible heat transfer elements 14 include ribs, flanging and wind deflector plates which also increase the surface area of the outside wall 13 or also generate a specific air flow which additionally supports the cooling effect. It may be assumed here that the outside wall 13 of the muffler 1 is usually arranged beneath the motor vehicle and therefore is exposed to the relative wind in driving during operation of the motor vehicle.

Figure 2:
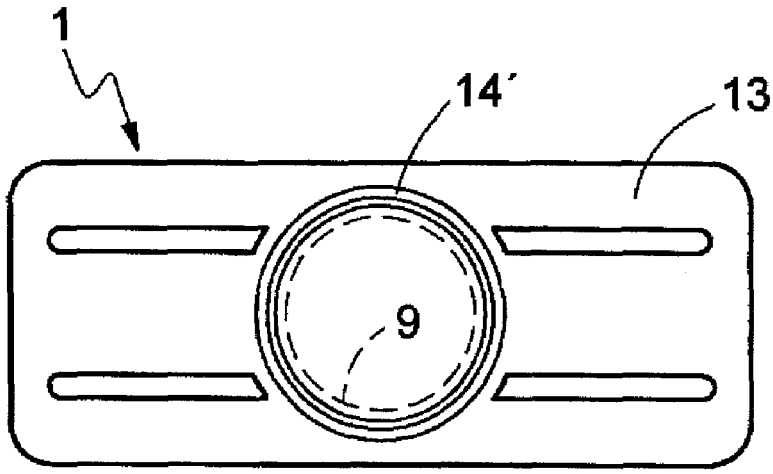
FIG. 2 shows a view of the outside of the inventive muffler.

In general, the thermal conductivity elements 14 may be designed as flanging or ribs, for example, as described above and may have either a straight line or curved shape. FIG. 2 shows a flanging 14' on the outside wall 13 which is essentially circular and is adapted to the shape of the diaphragm drive 9 so that the flanging 14' surrounds the diaphragm drive 9. Speaking in general terms, a surface of the outside wall 13 facing the diaphragm drive 9 may be adapted to the contour of the diaphragm drive 9 which faces the outside wall 13.

The coupling between the antinoise generator 3 and the outside wall 13 by the coupling element 11 also produces a reinforcement of the outside wall 13, so that it radiates outward much less antinoise that is produced by antinoise generator 3. Without any mechanical contact between the outside wall 13 and the diaphragm drive 9, the outside wall 13 would radiate much more structure-borne sound due to the high sound pressure level generated by the antinoise generator 3, so that to be able to counteract this, the sheet metal thickness of the outside wall 13 would have to be increased significantly, which would in turn result in a greater weight and a higher cost as well as a higher thermal inertia and would therefore have a negative effect on the dissipation of heat by the diaphragm drive 9.

The invention claimed is:

1. An active muffler for an exhaust system of an internal combustion engine, in particular in a motor vehicle, the active muffler comprising:

a muffler body structure comprising an outer wall, said muffler body structure receiving exhaust gas, one side of said outer wall being in contact with the environment;

a coupling element engaging another side of said outer wall of said muffler body structure;

an antinoise generator generating antinoise such that said antinoise cancels some of the sound transported via the exhaust gas, said antinoise generator having a diaphragm drive, said diaphragm drive being connected to said coupling element such that said coupling element reduces noise generated via said antinoise generator and conducts heat generated via said antinoise generator to said outer wall.

2. The muffler according to claim 1, wherein the coupling element consists of a heat-conducting and at a noise-reducing material.

3. The muffler according to claim 1, wherein the coupling element has a thickness of approximately 0.1 mm to 5.0 mm.

4. The muffler according to claim 1, wherein the antinoise generator is a loudspeaker, said loudspeaker having a vibration diaphragm that is excitable by the diaphragm drive.

5. The muffler according to claim 1, wherein said outer wall of said muffler body structure increases heat transfer with the environment.

6. The muffler according to claim 1, wherein said outer wall has at least one heat transfer element, said heat transfer element being one or more of flanging, a structured surface and a wind deflector plate.

7. The muffler according to claim 1, wherein a surface of said another side of said outer wall faces in a direction of said diaphragm drive, said another side of said outer wall having a contour substantially similar to a contour of said diaphragm drive.

8. The muffler according to claim 1, wherein:

said muffler body structure has a perforated tube, said perforated tube transporting the exhaust gas, said perforated tube being connected to a first space defined by said muffler body structure such that said pipe delivers sound of the exhaust gas to said first space; and said muffler body structure includes a partition, said partition defining a second space, said second space being separated from said first space via said partition, said antinoise generator being arranged in said second space, said partition having a wall opening, whereby said antinoise generator generates said antinoise in a direction of said first space through said wall opening.

9. The muffler according to claim 8, wherein said diaphragm of the antinoise generator seals said wall opening.

10. The muffler according to claim 8, wherein said diaphragm of said antinoise generator is part of said partition.

11. A motor vehicle muffler comprising:

a muffler housing body having an outer wall and a perforated tube, said outer wall having an inner surface and an outer surface, said outer wall being in contact with an outer environment;

a single piece partition and chassis part connected to said outer wall, wherein a portion of said outer wall and said single piece partition and chassis part define a first muffler space in fluid communication with said perforated tube, said perforated tube carrying an exhaust gas stream of an internal combustion engine, whereby sound transported in the exhaust gas enters said first muffler space, said single partition and chassis part and another portion of said outer wall defining a second muffler space in said muffler housing body, said single piece partition and chassis part having a wall opening;

an electronic sound absorber mounted to said single partition and chassis part such that a portion of said electronic sound absorber is arranged within said wall opening, said electronic sound absorber having a diaphragm drive, said electronic sound absorber being arranged in said second muffler space, said electronic sound absorber generating sound directed at said first muffler space for canceling some of the sound transported in the exhaust gas;

a coupling element engaging said inner surface of said outer wall and engaging said diaphragm drive such that said coupling element blocks noise generated via said electronic sound absorber from being transmitted to said outer wall and conducts heat generated via said electronic absorber to said outer wall, wherein the heat generated via said electronic absorber is dissipated to the environment via said outer wall and said coupling element.

12. A muffler according to claim 11, wherein said coupling element consists of a heat-conducting and a noise-reducing material.

13. A muffler according to claim 11, wherein said coupling element has a thickness of approximately 0.1 mm to 5.0 mm.

14. A muffler according to claim 11, wherein said outer wall has at least one heat transfer element, said heat transfer element being one or more of flanging, a structured surface and a wind deflector plate.

15. A muffler according to claim 11, wherein said inner surface of said outer wall faces in a direction of said diaphragm drive, said inner surface of said outer wall having a contour substantially similar to a contour of said diaphragm drive.

16. A motor vehicle muffler comprising:

a muffler housing body having an outer wall and a perforated tube, said outer wall having an inner surface and an outer surface, said outer wall being in contact with an outer environment;

a partition connected to said outer wall, wherein a portion of said outer wall and said partition define a first muffler space in fluid communication with said perforated tube, said perforated tube carrying an exhaust gas stream of an internal combustion engine, whereby sound transported in the exhaust gas enters said first muffler space, said partition and another portion of said outer wall defining a second muffler space in said muffler housing body, said partition having a wall opening;

an electronic sound absorber mounted to said partition such that said wall opening receives a portion of said electronic sound absorber, said electronic sound absorber having a chassis and a diaphragm drive, said electronic sound absorber being arranged in said second muffler space, said electronic sound absorber generating sound directed at said first muffler space for canceling some of the sound transported in the exhaust gas, said chassis of said electronic sound absorber being integrally connected to said partition such that said chassis and said partition form a single chassis partition component;

a noise reduction and heat conducting means engaging said inner surface of said outer wall and engaging said diaphragm drive for limiting a transfer of sound generated by said electronic sound absorber to said outer wall and for conducting heat generated via said electronic sound absorber to said outer wall such that the heat generated via said electronic sound absorber is dissipated to the environment.

17. A muffler according to claim 16, wherein said noise reduction and heat conducting means consists of a heat-conducting and a noise-reducing material.

18. A muffler according to claim 17, wherein said heat-conducting and a noise-reducing material has a thickness of approximately 0.1 mm to 5.0 mm.

19. A muffler according to claim 16, wherein said outer wall has at least one heat transfer element, said heat transfer element being one or more of flanging, a structured surface and a wind deflector plate.

20. A muffler according to claim 16, wherein said inner surface of said outer wall faces in a direction of said diaphragm drive, said inner surface of said outer wall having a contour substantially similar to a contour of said diaphragm drive.

* * * * *